US005992529A

United States Patent [19]

Williams

[11] Patent Number: 5,992,529

[45] Date of Patent: Nov. 30, 1999

[54] MIXING PASSAGE IN A FOAM FIRE FIGHTING NOZZLE

[75] Inventor: Dwight P. Williams, Vidor, Tex.

[73] Assignee: Williams Fire & Hazard Control, Inc., Vidor, Tex.

[21] Appl. No.: 08/991,401

[22] Filed: Dec. 16, 1997

Related U.S. Application Data

[60] Provisional application No. 60/032,990, Dec. 16, 1996, abandoned.

[51] Int. Cl.[6] ..... A62C 35/00

[52] U.S. Cl. ..... 169/14; 239/419; 239/424

[58] Field of Search ..... 239/416.4, 416.5, 239/417, 419, 424, 424.5, 456, 499; 169/14, 15

[56] References Cited

U.S. PATENT DOCUMENTS

| | | | |
|---|---|---|---|
| 1,561,848 | 11/1925 | Green | 239/418 |
| 2,643,916 | 6/1953 | White et al. | 239/499 |
| 2,832,424 | 4/1958 | Hurst | 169/15 |
| 3,693,884 | 9/1972 | Snodgrass et al. | 239/427.5 |
| 3,782,884 | 1/1974 | Shumaker | 239/456 |
| 3,816,061 | 6/1974 | Guth | 239/416.5 |
| 4,000,613 | 1/1977 | Fukumoto et al. | 239/417 |
| 4,103,827 | 8/1978 | Kumazawa | 239/8 |
| 4,497,442 | 2/1985 | Williams | 239/437 |
| 4,552,490 | 11/1985 | Neale | 239/456 |
| 4,640,461 | 2/1987 | Williams | 239/317 |
| 4,653,693 | 3/1987 | Steingass | 239/456 |
| 4,828,038 | 5/1989 | Williams | 169/15 |
| 5,012,979 | 5/1991 | Williams | 239/416.5 |
| 5,277,256 | 1/1994 | Bailey | 169/15 |
| 5,312,041 | 5/1994 | Williams et al. | 239/8 |
| 5,575,341 | 11/1996 | Baker et al. | 169/70 |
| 5,678,766 | 10/1997 | Peck et al. | 239/419 |
| 5,775,596 | 7/1998 | Whisman et al. | 169/15 |
| 5,779,158 | 7/1998 | Baker | 169/15 |

*Primary Examiner*—Andres Kashnikow
*Assistant Examiner*—Lisa Ann Douglas
*Attorney, Agent, or Firm*—Sue Z. Sharper

[57] ABSTRACT

An improved mixing passage in a foam fire fighting nozzle, the nozzle having a barrel with a first inlet to receive liquid under pressure and a second inlet to receive additive fluid and having a discharge end for discharging liquid and additive fluid. The additive fluid is communicated from the second inlet to the barrel discharge through a channel and a baffle is structured with said channel to provide a flow path for additive fluid through the baffle. The baffle cooperates with barrel wall portions to shape a relatively smooth annular liquid stream having a cross sectional area that diminishes to a minimum proximate the nozzle discharge. A mixing plate is affixed to the nozzle downstream of the baffle, the mixing plate being adapted together with the baffle to define a mixing passage in which additive distributes itself around 360° and exits into a portion of the shaped liquid stream at the point of minimum cross sectional area. The improved mixing passage is accomplished by further configuring the mixing plate with at least portions of a peripheral upstream facing side outwardly angled to at least partially deflect discharging fluid in a radially outward and downstream direction.

6 Claims, 3 Drawing Sheets

MIXING PASSAGE IN A FOAM FIRE FIGHTING NOZZLE

This application claims the benefit of the filing date of an earlier filed provisional patent application, Ser. No. 60/032,990, filed Dec. 16, 1996 now abandoned.

FIELD OF INVENTION

This invention relates to fire fighting nozzles and, in particular, to fire fighting nozzles providing a mixing area or passage proximate to and partially defined within a nozzle discharge area for the mixing of a primary fire fighting liquid with an additive fluid.

BACKGROUND OF INVENTION

This invention relates to an improvement to fire fighting nozzles of the type disclosed in U.S. Pat. No. 4,640,461, the disclosure of such patent being hereby incorporated by reference.

The fire fighting nozzle disclosed in the '461 patent is of a type that includes a mixing nozzle and/or passage located on or proximate to the discharge port of the nozzle. More particularly, the mixing passage area is partially located between an upstream deflecting plate and a downstream mixing plate. The upstream deflecting plate forms a portion of a baffle affixed proximate the discharge end of the nozzle barrel, serving as a baffle for the flow of primary liquid through the nozzle. As shown in the embodiments of the '461 patent, the mixing plate defines a downstream wall of the mixing area or passage and typically comprises a flat plate situated perpendicular to the direction of flow of the liquid. In some embodiments, the flat mixing plate has a portion of a peripheral edge slanted upstream. In such a manner, the mixing plate deflects additive fluid outward and to some extent also backward or upstream into a stream of primary fire fighting liquid. This deflection pattern can enhance the generation of superior foam, especially when the additive fluid comprises a foam concentrate or a foam concentrate and liquid.

In some cases the energy expended in deflecting foam concentrate outward, and even upstream, in order to form a superior foam, may sacrifice too much of the total range potentially achievable by the fire fighting nozzle.

The improved mixing passage or mixing area disclosed herein, through use of novel mixing plate configurations or shapes, achieves a fortuitous compromise between the generation of superior foam and the achievement of maximum range for a nozzle. The mixing plate configurations and shapes disclosed herein deflect fluid outwardly and also partially downstream through use of at least partially outwardly conically shaped portions of the plate.

SUMMARY OF THE INVENTION

The present invention relates to new and improved mixing passages in foam fire fighting nozzles, the nozzle having a barrel with a first inlet for receiving liquid under pressure and a second inlet for receiving additive fluid, such as foam forming concentrate. The barrel has a discharge end for discharging the liquid and fluid. The nozzle also has a channel providing communication for the additive fluid from the second inlet to the barrel discharge. A baffle is affixed within the barrel proximate the discharge end wherein the baffle and channel are structured in combination to provide a flow path for the additive fluid through the baffle. A mixing plate affixed to the nozzle downstream of the baffle is provided, the mixing plate being adapted together with the baffle to define a mixing passage. The improvement includes mixing plate configurations and shapes having at least portions of a peripheral upstream facing side being outwardly angled such that additive fluid exiting the baffle is at least partially deflected in an outward and downstream direction.

BRIEF DESCRIPTION OF THE DRAWINGS

The invention will be better understood and objects other than set forth above, will become apparent when consideration is given to the following detailed description thereof. Such description makes reference to the annexed drawings wherein.

The drawings are not to scale, but rather are scaled to illustrate the operational structure.

DETAILED DESCRIPTION OF THE PREFERRED EMBODIMENTS

The present invention involves an improved mixing passage in a foam fire fighting nozzle. The nozzle is comprised of a barrel with two inlets and an outlet, the first inlet for receiving a liquid such as water under pressure, the second inlet for receiving an additive fluid such as fire fighting foam. The barrel outlet serves as a discharge means for a mixture of the liquid and the fluid.

A channel is affixed on the inside of the barrel at the second inlet. The other end of the channel connects to a baffle located within the barrel proximate to the barrel discharge end. The baffle is located within the barrel such that the directional flow of the additive fluid is axially concentric to the liquid flow.

A mixing plate is located downstream of the baffle, where the additive fluid impinges after exiting the baffle. A mixing passage is defined by the area downstream of the baffle where the mixing plate is affixed to the nozzle. Since the face of the mixing plate protrudes axially outward, and downstream, the additive fluid is dispersed into the flow of liquid in the same direction the liquid is flowing. This invention provides a reduced pressure drop across the mixing passage since the fluid is dispersed in the same direction of the liquid flow. Thus an increased nozzle range is realized resulting in improved fire fighting capabilities, without sacrificing liquid and fluid mixing.

Figure 1:
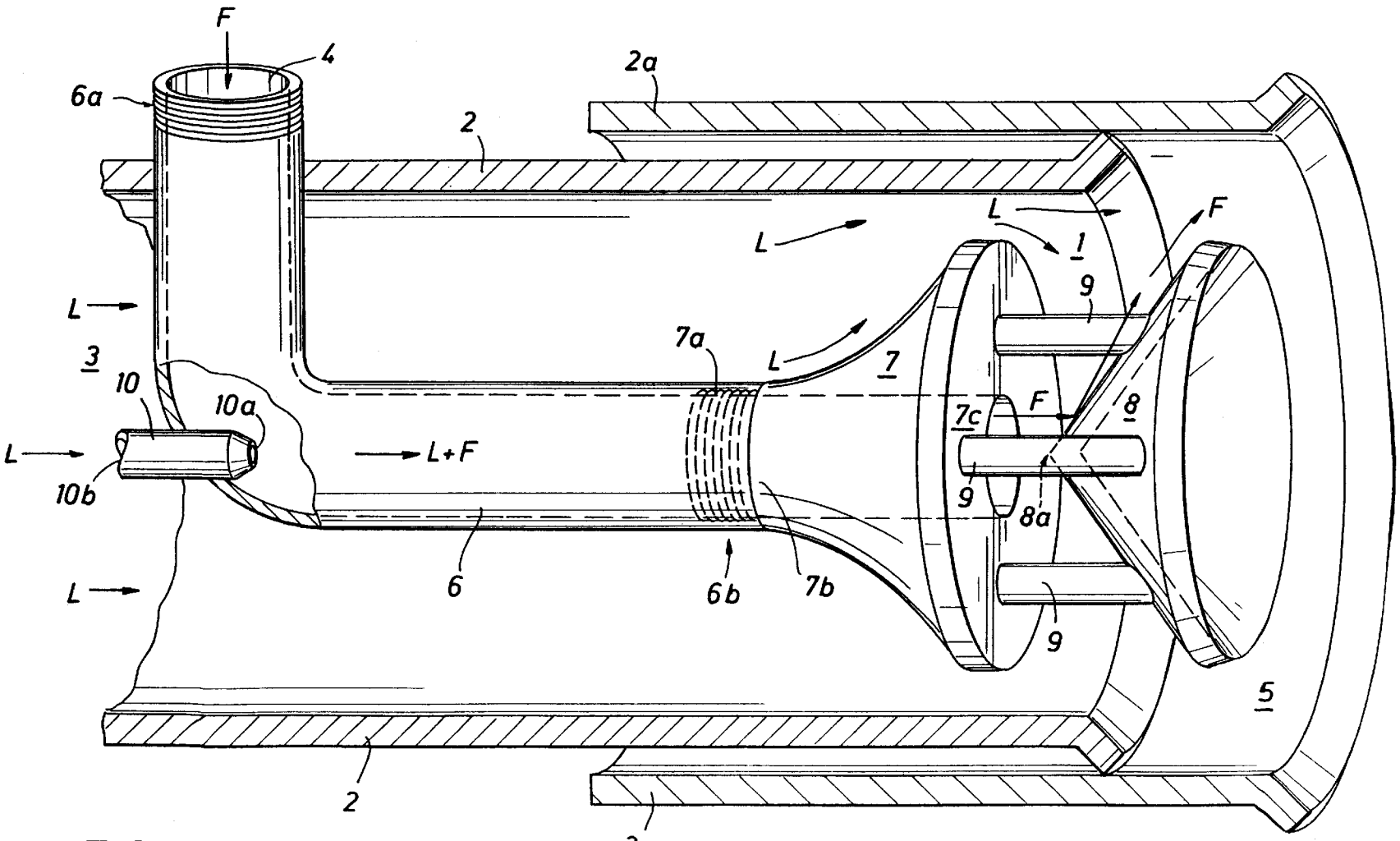
FIG. 1 illustrates a longitudinal view of one embodiment of an improved mixing passage in a foam fire fighting nozzle equipped with a barrel, a channel, a baffle and a mixing plate, the mixing plate having portions of a peripheral upstream facing side outwardly angled.

Describing now the drawings, one exemplary embodiment of the improved mixing passage will be seen in FIG. 1, comprising as its main parts or components a barrel 2 having a first inlet 3 for receiving liquid under pressure, a second inlet 4 for receiving additive fluid and a discharge end 5 for discharging a mixed liquid and fluid. The additive fluid may be introduced into the barrel by means of a channel 6, channel 6 having a male threaded inlet **6*a* and a female threaded outlet 6***b*. A baffle 7 is affixed within the barrel 2 proximate to the nozzle discharge 5. The baffle inlet 7*b* has a male threaded section 7*a* which is rotably mounted onto the female threaded outlet 6*b* of the channel 6. A mixing plate 8 is attached to the baffle 7 by means such as sleeved industrial fastener(s) 9 and proximate to the baffle deflecting plate 7*c*. The mixing plate 8 adapted together with the baffle 7 define the mixing passage or area 1. The combination of the channel 6 attached to the baffle 7 provides the flow path for the additive fluid into the mixing passage or area 1 between the baffle deflecting plate 7*c* and mixing plate 8. The mixing plate 8 of FIG. 1 can be seen to have a peripheral upstream facing side angled outwardly to partially deflect the additive fluid and liquid in an outward and downstream direction. The apex of the conical embodiment of the mixing plate 8 is located axially concentric and proximate to the opening of channel 6 in the baffle discharge. The mixing plate apex 8*a* provides an impingement point where the additive fluid and liquid contact and subsequently are directed towards the primary liquid flow. The liquid under pressure flows from the first inlet 3 through the barrel 2 until it reaches the baffle where liquid L is baffled outward and around mixing passage 1. There liquid contacts the additive fluid being deflected outward into the downstream direction. The mixing of the liquid with the additive fluid, enhanced by the fluid dynamic perturbations, creates superior quality fire fighting foam, which is discharged to the target location via the nozzle discharge 5. The discharge dynamics may be further altered from a fog to a straight stream pattern by moving the outer barrel 2*a* parallel to the flow. By moving the outer barrel 2*a* away from the nozzle discharge 5 a more narrow and straight fire fighting stream may be produced; conversely, positioning the outer barrel 2*a* inward toward the nozzle discharge 5 spawns a more dispersed fog like fire fighting stream.

A venturi nozzle or eductor 10 may be inserted into the channel 6, said venturi nozzle 10 having an inlet 10*b* for receiving a portion of pressurized liquid. The nozzle 10 having a reduced diameter exit 10*a* for discharging lower pressure liquid. Pressurized liquid flowing into the inlet 10*b*, being substantially noncompressible, exits the reduced diameter exit 10*a* at a higher velocity, thus a lower pressure. The lower pressure produces a venturi effect that induces fluid flow into and through the channel inlet 6*a* and onto the mixing plate 8. The venturi effect caused by the venturi nozzle 10 provides the motive force for the fluid flow.

Figure 2:
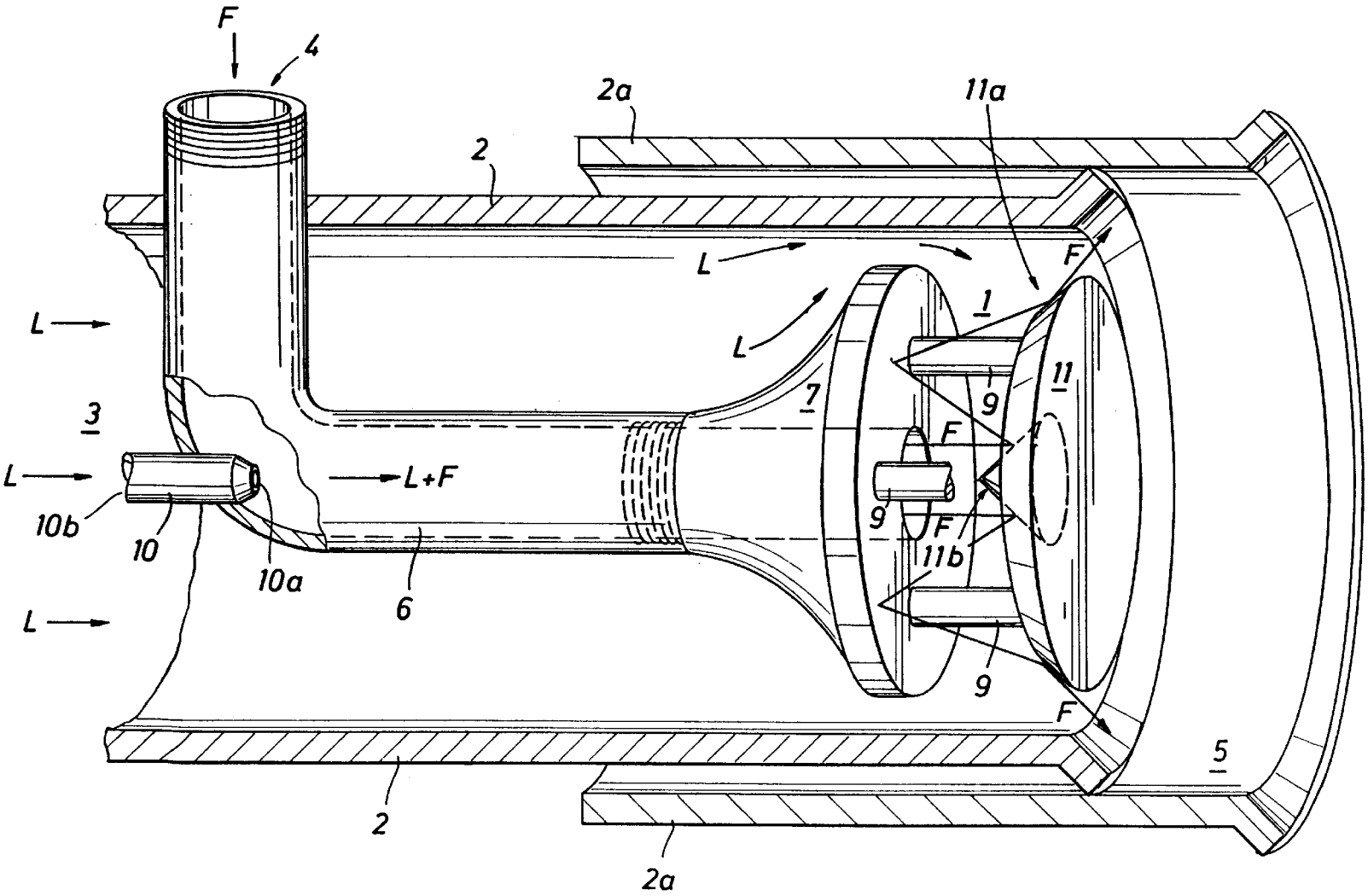
FIG. 2 illustrates an alternate preferred embodiment with a mixing plate having an outwardly beveled peripheral edge configuration of the mixing plate from FIG. 1.

FIG. 2 illustrates a preferred embodiment for the mixing passage 1. The improved mixing passage 1 is indicated wherein the alternate design mixing plate 11 includes an outwardly beveled peripheral edge 11*a*.

Figure 3:
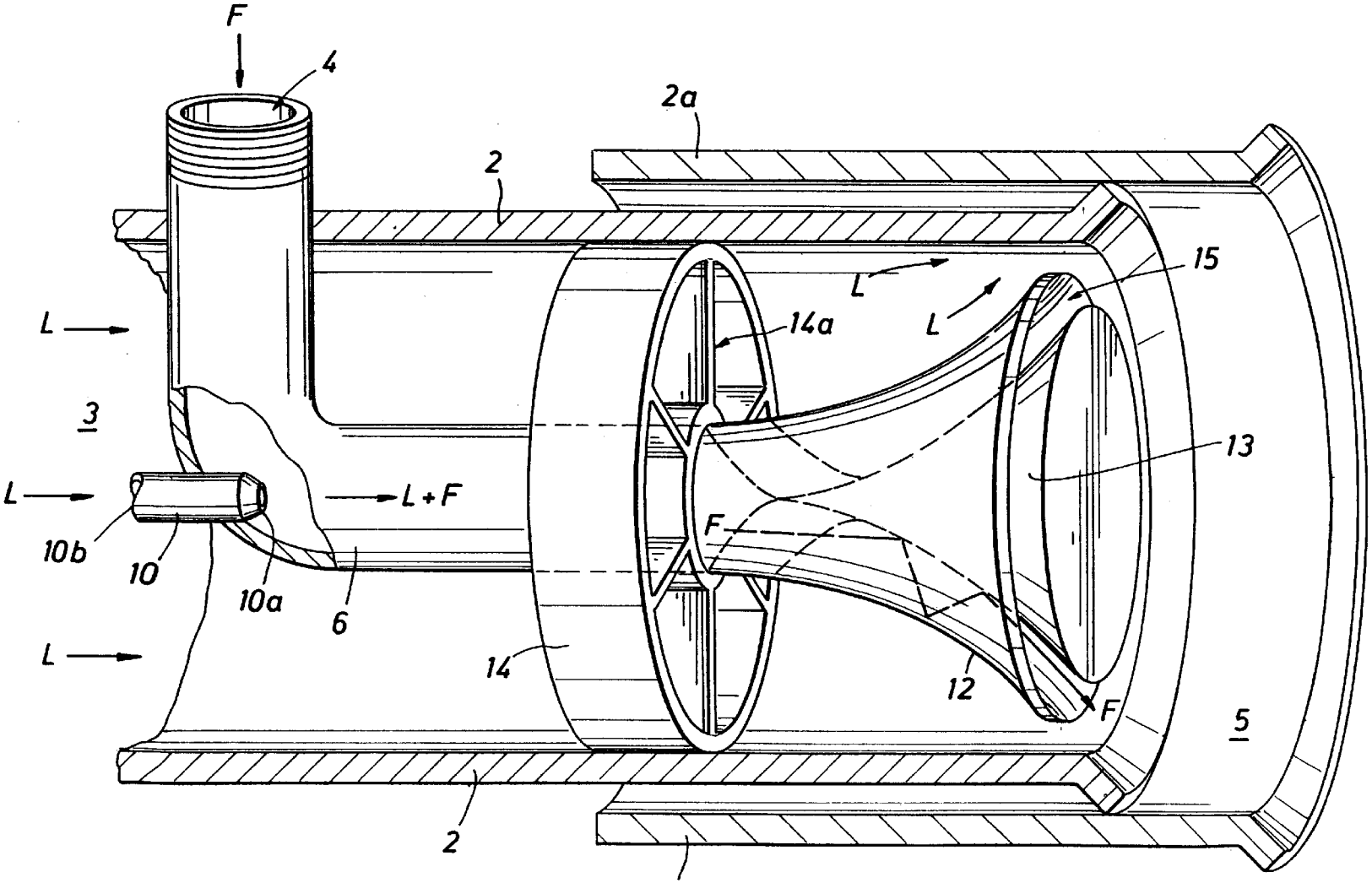
FIG. 3 illustrates an alternate longitudinal view of an improved mixing passage in a foam fire fighting nozzle from FIG. 1, having a baffle for the liquid flow through the barrel, and whereby the mixing plate and the baffle form a dual trumpet arrangement.

In addition to the structures elucidated in FIGS. 1 and 2, FIG. 3 depicts an alternatively designed trumpet shaped baffle 12 and mixing plate 13 arrangement; together with a fin 14. Here, the mixing plate 13 and the baffle 12 both have a substantially conical configuration. The mixing passage 15 is defined by the space between the substantially conical mixing plate 13 and baffle 12. The fin 14 is comprised of vanes 14*a* radially extending from the outer wall of the channel 6 to the inner surface of the barrel 2. The vanes 14*a* straighten the pressurized liquid flow, which can tend to reduce pressure head loss in the nozzle, resulting in a higher nozzle discharge velocity, ultimately increasing the effective fire fighting radius of the foam fire fighting nozzle.

In the operation of the improved mixing passage in a foam fire fighting nozzle, barrel 2 is affixed to a liquid pressure source, generally a fire hydrant or fire truck or other suitable pump. As liquid L is pressure forced into the barrel 2 a portion of the liquid flows through venturi nozzle 10. Reducing the venturi nozzle exit 10*a* cross sectional area with respect to venturi nozzle entrance 10*b* causes the velocity of the substantially noncompressible liquid to increase, thereby generally producing a localized reduced pressure inside channel 6. Whereby, reduced pressure can induce additive fluid F into and through channel 6. Additive fluid F flows from its supply into channel 6, contacts the portion of liquid L that flows through the venturi nozzle, the fluid and liquid portion flow through channel 6, through attached baffle 7, into mixing passage 1 and onto mixing plate 11 (or 8 in FIG. 1). The mixture of the fluid land a portion of the liquid impinge upon the mixing plate on mixing plate apex 11*b* (or 8*a* in FIG. 1). Fluid dynamics of the fluid and liquid portion, affected by the predominate liquid L flowing through barrel 2 and around mixing passage 1 result in fluid F and the liquid portion "ricocheting" between the baffle deflecting plate and mixing plate, while mixing with the predominate liquid L in the mixing passage. Subsequently these dynamic perturbations mix the fluid and the liquid creating a superior fire fighting foam for use in fire fighting activities. Mixing plate 11 and alternative embodiment mixing plate 8 are configured to have at least portions of a peripheral upstream facing side outwardly angled such that additive fluid F exiting baffle 7 is at least partially deflected in an outward and downstream direction. Since mixing plate 11 and alternative mixing plate 8 direct the fluid in the same direction as flowing liquid L this can result in a lower head pressure loss across the mixing plate than in previous inventions, thereby resulting in a higher mixed liquid fluid velocity from the nozzle and increasing fire fighting capabilities.

The extension or retraction of outer barrel 2*a* can alter the pattern of the fire fighting foam exiting the nozzle from a foam-like application to a straight stream application. When the outer barrel 2*a* is fully retracted relative to barrel 2 less barrel length is available to direct the mixture of the fluid and the liquid, thus the mixture can be dispersed radially outward sooner after exiting the barrel, producing a more dispersed and greater diameter of flow.

When the outer barrel 2*a* is extended relative to barrel 2 more barrel length is available to direct the mixture of the fluid and the liquid, thus maintaining a straighter stream exit from the nozzle.

While there are shown and described present preferred embodiments of the invention, it is to be distinctly understood that the invention is not limited thereto, but may be otherwise variously embodied and practiced with the scope of the following claims. ACCORDINGLY,

What is claimed is:

1. An improved mixing passage in a foam fire fighting nozzle, said nozzle having:

a barrel with a first inlet for receiving liquid under pressure, a second inlet for receiving additive fluid and a discharge end for discharging liquid and fluid;

a channel providing communication for said additive fluid from said second inlet to said barrel discharge end;

a baffle affixed within said barrel proximate said discharge end; said baffle cooperating with barrel wall portions to shape liquid flow proximate the nozzle discharge end into a relatively smooth annular stream having a cross sectional area that gradually diminishes to a minimum;

a discharge passage for said additive from said channel, the channel, barrel and baffle being relatively located such that additive fluid is discharged into a portion of the shaped annular liquid stream at the minimum cross sectional area and such that said additive fluid is at least partially discharged in an outward and downstream direction.

2. The improved mixing passage of claim 1 wherein said baffle and said mixing plate each exhibit an at least partially conical shape.

3. The improved mixing plate of claim 1 wherein said mixing plate includes an outwardly beveled peripheral edge.

4. The improved mixing plate of claim 1 wherein said mixing plate comprises a substantially hollow conical structure affixed to said baffle with the apex of said conical structure located upstream.

5. The improved mixing plate of claim 4, further comprising:

at least one fin proximate the baffle and having a plurality of vanes, said vanes radially extended from the channel to the barrel, whereby extending the range of the firefighting nozzle.

6. An improved method for mixing fluids in a fire fighting nozzle comprising:

(a) supplying a liquid fire fighting fluid under pressure to a first inlet of a nozzle barrel;

(b) supplying an additive fluid to an additive fluid inlet of said nozzle barrel;

(c) baffling and shaping liquid flow through the barrel proximate a barrel discharge end into a relatively smooth annular stream having a cross sectional area that gradually diminishes to a minimum;

(d) supplying said additive fluid to said discharge end of said barrel; and (e) discharging the additive fluid into a portion of the shaped annular liquid stream at the minimum cross sectional area in both a radially outward and downstream direction.

* * * * *

UNITED STATES PATENT AND TRADEMARK OFFICE

CERTIFICATE OF CORRECTION

PATENT NO. : 5,992,529
DATED : November 30, 1999
INVENTOR(S) : Dwight P. Williams It is certified that error appears in the above-identified patent and that said Letters Patent is hereby corrected as shown below:

On Col. 4, line 12 delete "land" and insert --and--.

On Col. 4, line 14, delete "8a" and insert --8b--.

On Col. 4, line 59, after "end", delete ";" and insert --,--.

On Col. 4, line 66, after "stream", delete "at the" and insert --having--.

On Col. 5, lines 3, 6, 8 and 12, after "improved", delete "mixing plate" and insert --discharge passage--.

Signed and Sealed this

Twenty-sixth Day of December, 2000

*Attest:*

Q. TODD DICKINSON

*Attesting Officer*

*Director of Patents and Trademarks*